United States Patent [19]

Koine

[11] 4,263,836

[45] Apr. 28, 1981

[54] SEALING SYSTEM FOR A SLIDING WEDGE TYPE BREECH BLOCK OF A BARREL WEAPON

[75] Inventor: Richard Koine, Ratingen, Fed. Rep. of Germany

[73] Assignee: Rheinmetall GmbH, Duesseldorf, Fed. Rep. of Germany

[21] Appl. No.: 50,055

[22] Filed: Jun. 19, 1979

[30] Foreign Application Priority Data

Jun. 19, 1978 [DE] Fed. Rep. of Germany ..... 2826559

[51] Int. Cl.[3] ..... F41D 11/16

[52] U.S. Cl. ..... 89/26; 89/27 R; 89/28 A

[58] Field of Search ..... 89/24, 26, 27 R, 28 R, 89/28 A

[56] References Cited

U.S. PATENT DOCUMENTS

| | | | |
|---|---|---|---|
| 827,725 | 8/1906 | Hammar | 89/28 A |
| 2,117,885 | 5/1938 | Hasek | 89/26 |

*Primary Examiner*—Stephen C. Bentley

[57] ABSTRACT

Sealing system for a sliding wedge type breech block of a barrel weapon, particularly one which employs cartridge free ammunition. An actuating member having a rear end adapted to be driven is disposed in the breech block, and an axially movable pressure bolt having an impacting surface is engaged and driven by the actuating member. A sealing means including a sealing member is provided between the actuating member and the breech block for separating the pressure bolt area from the actuating member. The sealing member is generally of disc shape, having a circular cylinder flange attached to its rim and a central support hub with an end surface functioning as a stop for the impacting surface of the pressure bolt. The circular cylindrical flange of the sealing member is disposed against the inside of a circular cylindrical recess in the forward end of the breech block, and the disc has an outer annular end surface for pressing against a transverse sealing surface at the rear end of the barrel. A mechanical guide means is provided between the actuating means and the pressure bolt, such guide means transforming rotary motion of the actuating means into an axial linear motion of the pressure bolt. An ignition or firing pin is attached to the forward end of the pressure bolt.

11 Claims, 4 Drawing Figures

SEALING SYSTEM FOR A SLIDING WEDGE TYPE BREECH BLOCK OF A BARREL WEAPON

BACKGROUND OF THE INVENTION

1. Field of the Invention

The present invention relates to a sealing system for a wedge type breech block of a barrel weapon.

2. Description of the Prior Art

A sealing arrangement for the breech block of a barrel weapon is disclosed in German Pat. No. 25 54 728. The arrangement is adapted for use with weapons of large caliber such as 150 mm, and employs parts which are expensive due to their large number and the required accuracy of their machining. The parts must be made of sufficient strength to contain the propellent gas pressures. Such requirements are also encountered in automatic weapons, which are built only in relatively smaller calibers.

SUMMARY OF THE INVENTION

1. Purposes of the Invention

It is an object of the present invention to provide a sealing system for a breech block of a barrel weapon, such sealing system being subject to wear at high firing rates of automatic barrel weapons, which are relatively small compared to the rates of wear of the sealing systems of hitherto known automatic barrel weapons.

Another object of the present invention is to provide a sealing system of the type described employing parts which are movable during the operation of the weapon which have relatively small masses, such sealing system having a sufficient reliability so that high mobility of the weapon is ensured.

It is a further object of the invention to provide a sealing system for a wedge type breech block, such system having a relatively small number of parts, thereby facilitating weapon maintenance procedures and the storage of the parts of such weapons.

These and other objects and advantages of the present invention will become evident from the description which follows.

2. Brief Description of the Invention

The present invention provides a sealing system for a sliding wedge type breech block of a barrel weapon, and is particularly useful in weapons employing cartridge free ammunition. An actuating member is rotatably positioned in the breech block, such member having a rear or outer end adapted to be driven. An axially movable pressure bolt is engaged by the actuating member, such pressure bolt having an impacting surface at or adjacent the forward end thereof. Between the actuating member and the breech block there is disposed a sealing means for separating the pressure bolt area from the rear actuating end of the actuating member, and to prevent the escape of the propellent gas to the rear. Preferably the sealing means is provided by a conical surface on the actuating member which contacts a conical seat on the breech block. The pressure bolt is preferably engaged with the actuating member by being slidably mounted in an axial bore in the forward end of the actuating member. A helical slot in the wall of the actuating member at such bore serves as a first guide means, and the pressure bolt has on its circular cylindrical outer surface a protruding element forming a second guided means which engages the first guide means. A straight axially extending guide groove in a recess of the forward end of the breech block which receives the forward end of the actuating member and the pressure bolt restrains the protruding element on the pressure bolt from rotation while permitting its axial movement. The area behind the rear end of the pressure bolt can be open and can communicate with the bore within the barrel of the weapon.

A firing pin can be attached to the forward end of the pressure bolt, such pin forming a mechanical initiator for detonation of the charge of the weapon. Alternatively, an ignition pin can be attached to the pressure bolt for forming an electrical initiator for a detonation of the charge.

To ensure sealing between the rear end of the barrel of the weapon and the closed breech block, there is provided a disc-like sealing member which is received within an annular recess in the forward end of the breech block. Such sealing member has a circular cylindrical flange attached to the rim thereof and a central hub having an axially extending passage therethrough receiving the forward end of the firing pin or electrical initiator. The hub of the sealing member has a transverse rear surface which functions as a stop for the forward, impact end of the pressure bolt. The transverse forward surface of the circular cylindrical flange of the sealing member sealingly engages the transverse rear end surface of the weapon barrel when the breech block is closed. In a preferred embodiment of the invention, the sealing member comprises a plurality (between about 3 and 20) of radial stiffening ribs which connect the hub thereof to the rim. Alternatively, the sealing member can be made in the form of a cylindrical outer flange attached to the rim of an annular disc-like member, and a separate central support ring.

The invention accordingly consists in the features of construction, a combination of elements, an arrangement of parts which will be exemplified in the device hereinafter described, and of which the scope of application will be indicated in the appended claims.

BRIEF DESCRIPTION OF THE DRAWINGS

In the accompanying drawings, which illustrate one of the various possible embodiments of the invention.

DETAILED DESCRIPTION OF THE PREFERRED EMBODIMENT

Figure 1:
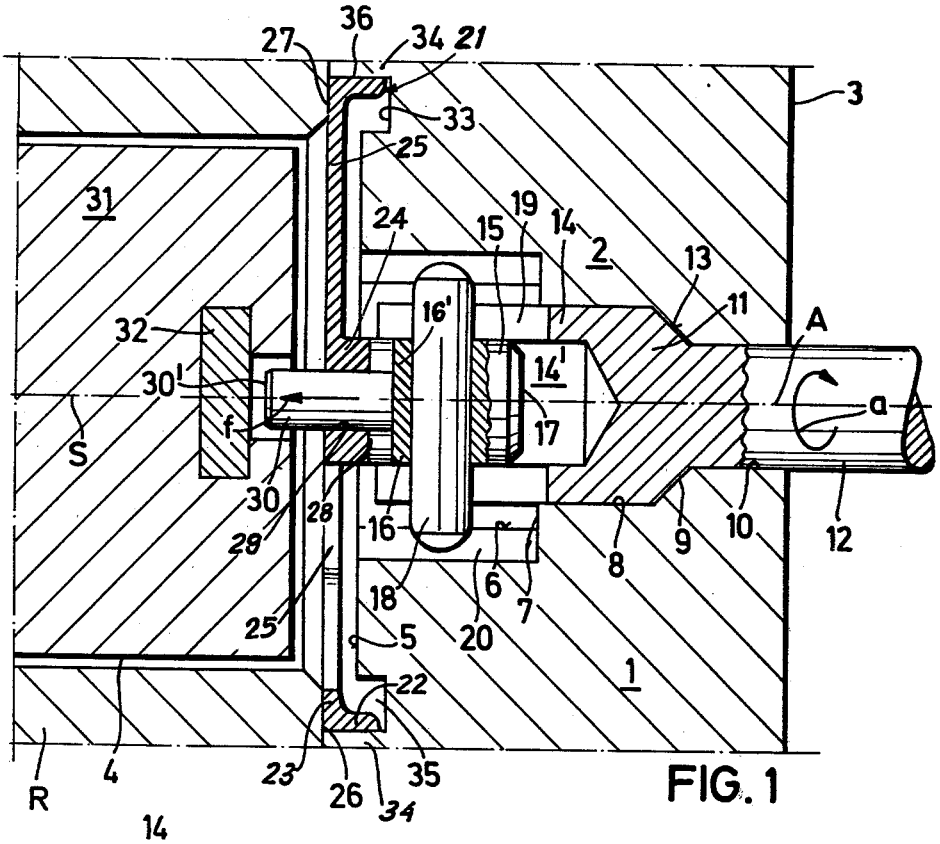
FIG. 1 is a fragmentary view in axial section of a barrel weapon employing the sealing system of the invention, the figure particularly showing the rear end of the weapon barrel and the breech block associated therewith, certain of the parts being shown in elevation.
Figure 2:
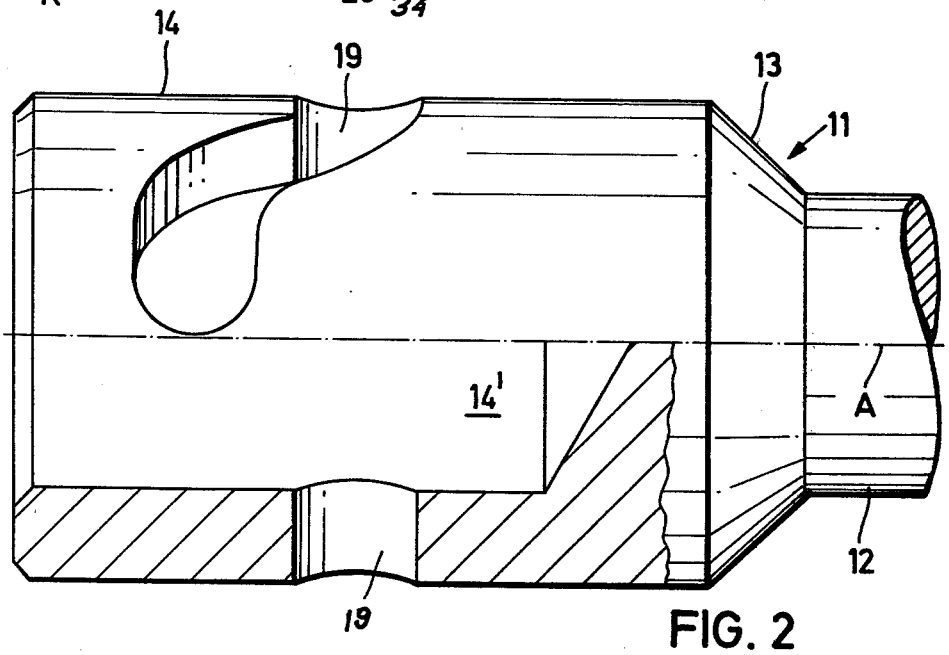
FIG. 2 is a fragmentary view in elevation on an enlarged scale of the forward end of the actuating member of the sealing system of the invention.

Turning now to FIG. 1, there is there shown a wedge-type breech block 1 which is shown in its closed position in which it closes and seals the rear end of a weapon barrel R. In such position of the breech block 1, it and the barrel R have a common axis S. The breech block has a cavity or recess 2 therewithin, such cavity being made up of a first, forward portion 6, in intermediate portion 8, and a rear portion 10, portion 6 having a diameter larger than portion 8, and portion 8 having a diameter larger than that of portion 10. Portion 6 of the cavity is joined to portion 8 by a transverse annular shoulder 7, and portion 8 is joined to portion 10 of the cavity by a rearwardly converging frusto-conical surface 9 functioning as a valve seat.

The rotatable actuating member accurately fits within the above-described cavity in the breech block, the actuating member having a portion 14 fitting within portion 8 of the cavity, a valve member-forming frusto-conical portion 13 which cooperates with the valve seat 9 of the cavity, and a circular cylindrical rear portion 12 which fits within part 10 of the cavity in the breech block. Part 12 of the actuating member is connected to an actuating or driving means (not shown).

The forward end of the enlarged portion 14 of the actuating member is provided with a forwardly open central bore 14' which accurately receives a pressure bolt 15 which is axially slidable therewithin. A cross pin 18 is disposed in a transverse bore through the bolt 15, the radially outer ends of pin 18 being axially slidably received within axially extending grooves 20 in the wall of portion 6 of the cavity within the breech block. The opposite side walls of part 14 of the actuating member are provided with similar helical slots 19 which receive the portions of the cross pin 18 protruding outwardly of the bolt 15, rotation of the actuating member in the direction of the arrow a in FIG. 1 causing the pressure bolt 15 to be driven to the left in the direction of the arrow f.

Figure 3:
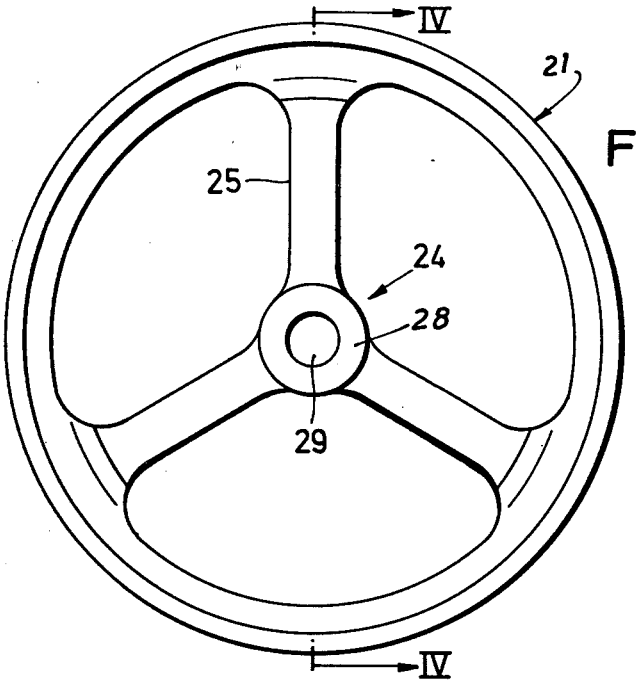
FIG. 3 is a view in end elevation of the member which forms a seal between the rear end of the weapon barrel and the breech block.
Figure 4:
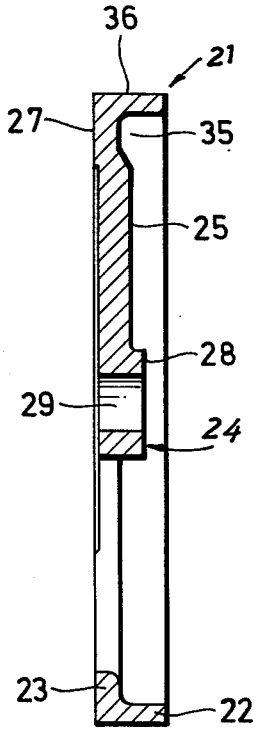
FIG. 4 is a view in section of the sealing member of FIG. 3, the section being taken along the line of IV—IV of FIG. 3.

Attached to the forward end portion 16 of bolt 15 coaxially thereof is a firing pin 30, the rear end of firing pin 30 being joined to the forward end portion 16 of bolt 15 by a transverse annular impact surface 16''. The firing pin 30 accurately fits within the central bore 29 in the hub 24 of a sealing member 21 which is particularly shown in FIGS. 3 and 4. Member 21, which is of generally disc shape, has a circular cylindrical rim portion 22 and an annular portion 23 integral therewith. The outer portion 22,23 of member 21 is attached to the hub 24 thereof by radially directed spoke-like members 25, there being three members 25 equally angularly spaced about the axis of member 21 as shown in FIG. 3.

The sealing member 21 is received within an annular recess 33 in the forward end of the breech block 1, recess 33 being coaxial of the barrel R and of the breech block when the parts are assembled as shown in FIG. 1. The breech block has a forwardly protecting annular flange 34 which defines the outer boundary of the recess 33, the peripheral surface 36 of the flange 22 accurately but slidingly engaging the inner surface of the flange 34. The sealing member 21 has an outer transverse annular sealing surface 27 which engages the transverse rear end surface of the barrel R.

As mentioned above, the turning of the actuating member in the direction of the arrow a causes the bolt 15 and the firing pin 30 attached thereto to be thrust to the left. This causes the impact surface 16' on bolt 15 to engage the rear transverse annular surface 28 on the hub 24 of the sealing member 21, thereby thrusting the sealing member 21 to the left so that the transverse annular surface 27 of the sealing member sealingly engages the transverse rear end surface of the barrel R.

Such thrusting of the firing pin 30 to the left causes its forward end 30' to engage a detonator 32 disposed within a charge 31 in the chamber 4 of the barrel R. This causes the charge 31 to be detonated.

It will be seen that the chamber 4 in the barrel is in communication at all times with the cavity and the breech block 1, such communication being provided between the spoke-like members 25 of the sealing means 21, which as shown in FIG. 1, are spaced forwardly of the forward end surface 5 of the breech block. Gases from the detonated propellant pass into the annular space 35, which lies radially inwardly of the flange 22 of sealing means 21, along the forward surface 5 of the breech block and cause member 21 to be thrust to the left so that the annular transverse surface 26 thereof sealingly engages the transverse rear end surface 26 of the barrel R.

Means, not shown, is provided to maintain the surface 13 of valve member 11 constantly in sealing engagement with the conical seat 9 in the breech block 1. Such means may, for example, take the form of a wavy annular spring disposed between an annular shoulder on part 12 disposed rearwardly of the rear side 3 of the breech block, the spring acting between such shoulder and side 3 of the breech block constantly to thrust the actuating member to the right with respect to the breech block. The mating surfaces 9 and 13 of the valve are made of high quality materials and are highly polished to allow rotation of the valve 11 while performing as a seal.

The above-described sealing system operates as follows:

A cartridgeless propellent charge 31 having a propellent detonator 32 is placed in the chamber 4 of the barrel R. The sliding wedge type breech block is then closed and assumes the position shown in FIG. 1. In order to fire the charge, the actuating member is rotated by turning its part 12 clockwise in the direction of arrow a. This causes the guide pin 18 in the pressure bolt 15 to move forward to the left in the direction of arrow f by means of the transfer of force from the guide slots 19 to the transverse guide pin 18 which can move only in an axial direction because of the interaction of the pin 18 with the grooves 20. The stop face 16' engages the transverse rear surface 28 of the hub 24, resulting in movement of the central hub 24 together with the sealing member 21 in the direction of the arrow f. Continuing motion of the sealing member 21 in that direction results in contact between surface 27 of the sealing member and the sealing surface 26 of the valve R. The sealing member 21 is guided in such motion by the inner cylindrical surface 34 of the recess 33. A mutual guiding is insured by the fact that the firing pin 30 passes through the central hole 29 in the central hub 24 of the sealing member 21.

As above noted, the axes A and S are in alignment. In order for the front end or face 30' of the firing pin 30 to reach the propellent detonator 32 and to initiate the firing of the round, in the example illustrated, there is a small overstroke of the axial motion: The surface 27 of the sealing member 21 begins to contact the sealing surface 26 on the rear end of the barrel R after the front surface 30' of the firing pin 30 reaches and has initiated the firing of the propellent detonator 32. Therefore, possible limited axial and production-induced deviations in the position of the propellent detonator 32 within the propellent body 31 do not cause any difficulties in the firing of the weapon. The advantageous coordination of firing and sealing in a single axial motion causes the sealing member 21 to be accelerated in its axial forward movement. As a result, propellent gases which are produced on the firing of the round, reach the area 35 only after sealing engagement between the surfaces 26 and 27 has occurred.

The rapid pressure increase in the annular space 35 results in the sealing of the breech block by elastically pressing the annular surface 27 of the sealing member 21 against the sealing surface 26 on the rear of the barrel R, and the elastic pressing of the outer surface of the flange 22 of the sealing member 21 against the inner cylindrical surface of the flange 34 of the breech block.

Gases produced by the detonated propellant also move through the guiding slots 19, which act as gas passages, into the inner space 14' of the member 14 behind the rear end face 17 of the pressure bolt 15. Since the pressure bolt is surrounded on all sides by such gas, it is in a near equilibrium position relative to the propellent gas pressure. Because by the continuing contact of the conical valve member surface 13 with the conical seat surface 9 in the recess or cavity 2, which is ensured by the above described but unillustrated spring acting between the actuating member and the body of the breech block, the propellent gases not only are prevented from rearward escape through such valve surfaces, but they also generate an additional pressure upon the valve member 11 which tends to increase the sealing contact between surfaces 9 and 13. This construction prevents with certainty the erosions known from other conventional arrangements. The presence of a single and at the same time small sealing region within the recess or cavity 2 results in particular advantages. Such a small sealing region is controllable with few and simple means. A higher degree of functional safety can be assured by employing elements in the system which are made of hard-wear resistant materials which exhibit negligible wear over long periods of use.

After the firing of a round, the pressure bolt 15 is brought back into its original position by rotating the actuating member counterclockwise, that is, in the direction opposite that shown by the third arrow a. The sealing member 21 is prevented by a pre-set tolerance relative to the sealing surface 26 from falling out of the recess 33 when the breech block 1 is opened or closed. Therefore, advantageously no additional provisions are necessary for maintaining the sealing member 21 in place. An additional advantage is provided by the short operating and actuating motions required in the operation of the sealing system of the invention, since they assure safe functioning of the arrangement, even at high firing rates. Finally, the parts of the present sealing system are easily accessible. The additional advantages resulting therefrom are obvious without further details, such as similicity of maintenance and parts exchange.

It is easy to recognize that the present invention provides for a multiplicity of applications, for example, in the case of weapons with contactless firing. For reasons of simplicity, the present invention has been described above by way of an example employing a mechanical firing system. In an electrical firing system, the firing pin 30 is replaced by an ignition pin. The energy supply and the insulation required for such system are not here shown.

The sealing member 21 and its central support hub 24 can have various forms within the present invention. If the central hub 24 and the disc with the circular cylindrical flange 22 are formed as one piece, then the centrally directed tension in such part has to be considered. Such tension is exerted by the radial stiffening elements 25 on the circular cylindrical flange 22. This tension prevents a full-surface contact of the outer flange surface 36 against the immediately neighboring inner circular cylindrical surface of the flange 34 on the breech block. The flange 22 therefore has to be long enough in the axial direction to provide for sufficient sealing.

Although it is advantageous for handling to have a one-piece sealing member 21, the required length of the circular cylindrical flange 22 in the axial direction has to be considered in the design and construction of the system. When the sealing member 21 has a separate central support hub 24, there are resulting structural advantages which flow from the now possible shorter axial lengths of the circular cylindrical flange 22. The choice between having a one-piece sealing member versus a separate central support hub has to be decided in connection with the advantages available and the specific system considered.

It will thus be seen that the present invention provides a device which achieves the various objects of the invention and which is well adapted to meet conditions of practical use.

As various possible embodiments may be made of the above invention, and as various changes may be made in the embodiment above set forth, it is to be understood that all matter herein described as shown in the accompanying drawings is to be interpreted as illustrative and not in a limiting sense.

Although the invention is illustrated and described with reference to one preferred embodiment thereof, it is to be expressly understood that it is in no way limited to the disclosure of such a preferred embodiment, but is capable of numerous modifications within the scope of the appended claims.

I claim:

1. A sealing system for the sliding wedge type breech block of a barrel weapon comprising: an actuating member rotatably positioned in the breech block, the actuating member having a rear end to be rotatably driven, an axially movable pressure bolt engaged with the actuating member, the pressure bolt having an impacting surface, sealing means between the actuating member and the breech block for separating the pressure bolt area from the driven end of the actuating member; a sealing member having a circular cylindrical flange attached to the rim of an annular disc and a central support hub with a support surface providing a stop for the impact surface of the pressure bolt, said circular cylindrical flange being disposed against the inside of a circular cylindrical surface of the breech block, said annular disc having a transverse annular flange with an outer front annular surface for pressing against a sealing surface on the rear end of the barrel, and a transmission means comprising a mechanical guide means for transforming a rotating motion of the actuating member into a linear motion of the pressure bolt in an axial direction.

2. The sealing system as set forth in claim 1, wherein the sealing means is provided by a rearwardly converging conical surface on the actuating member contacting a similarly shaped conical seat on the breech block.

3. The sealing system as set forth in claim 1, wherein the pressure bolt is slidably mounted in an axial bore in the actuating member.

4. The sealing system as set forth in claim 3, wherein there is a helical slot in the inner wall of the bore in the actuating member constituting a first guide means, and wherein the pressure bolt has on its outer circular cylindrical surface a protruding element forming a second guide means which engages the first guide means.

5. The rearward sealing system as set forth in claim 4 wherein the breech block has a straight guide groove for restraining the protruding element to a motion in axial direction.

6. The sealing system as set forth in claim 1, wherein the area behind the rear end of the pressure bolt openly communicates with the inside of the barrel.

7. The rearward sealing system as set forth in claim 1, comprising a firing pin attached to the front end of the pressure bolt and forming a mechanical initiator for the detonation of the explosive charge of the weapon.

8. The sealing system as set forth in claim 1, comprising an ignition pin attached to the front end of the pressure bolt and forming an electrical initiator for detonating the explosive charge of the weapon.

9. The sealing system as set forth in claim 1, wherein the barrel of the weapon is loaded with a cartridgeless charge.

10. The sealing system as set forth in claim 1, wherein the sealing member comprises a plurality of angularly spaced radial stiffening ribs extending between the transverse annular flange and the central support hub.

11. The sealing system as set forth in claim 1, wherein the sealing member is provided by a cylindrical outer flange attached to an annular disc and by a separate central support hub.

* * * * *